United States Patent [19]

Striebel et al.

[11] 4,395,874

[45] Aug. 2, 1983

[54] FUEL NOZZLES WITH WATER INJECTION FOR GAS TURBINE ENGINES

[75] Inventors: Edmund E. Striebel; Francis C. Pane, Jr., both of South Windsor, Conn.

[73] Assignee: United Technologies Corporation, Hartford, Conn.

[21] Appl. No.: 212,175

[22] Filed: Dec. 2, 1980

[51] Int. Cl.[3] ..... F02C 7/22

[52] U.S. Cl. ..... 60/39.58; 60/748; 239/400; 239/404

[58] Field of Search ..... 60/39.53, 39.55, 39.58, 60/39.59, 748; 239/400, 404

[56] References Cited

U.S. PATENT DOCUMENTS

| | | | |
|---|---|---|---|
| 2,701,164 | 2/1955 | Purchas et al. | 239/400 |
| 3,768,250 | 10/1973 | Kawaguchi | 60/748 |
| 3,820,320 | 6/1974 | Schirmer et al. | 60/748 |
| 3,886,736 | 6/1975 | Kawaguchi | 60/748 |
| 3,979,069 | 9/1976 | Garofalo | 239/400 |
| 4,290,558 | 9/1981 | Coburn et al. | 60/39.55 |

*Primary Examiner*—Louis J. Casaregola

*Attorney, Agent, or Firm*—Norman Friedland

[57] ABSTRACT

A pressure atomizing fuel nozzle of the type that has a primary and secondary fuel system for a gas turbine engine and includes air swirl means and water injection is designed so that the water laden airstream is swirling in the same direction as both the fuels egressing from the primary fuel system and the secondary fuel system.

4 Claims, 1 Drawing Figure

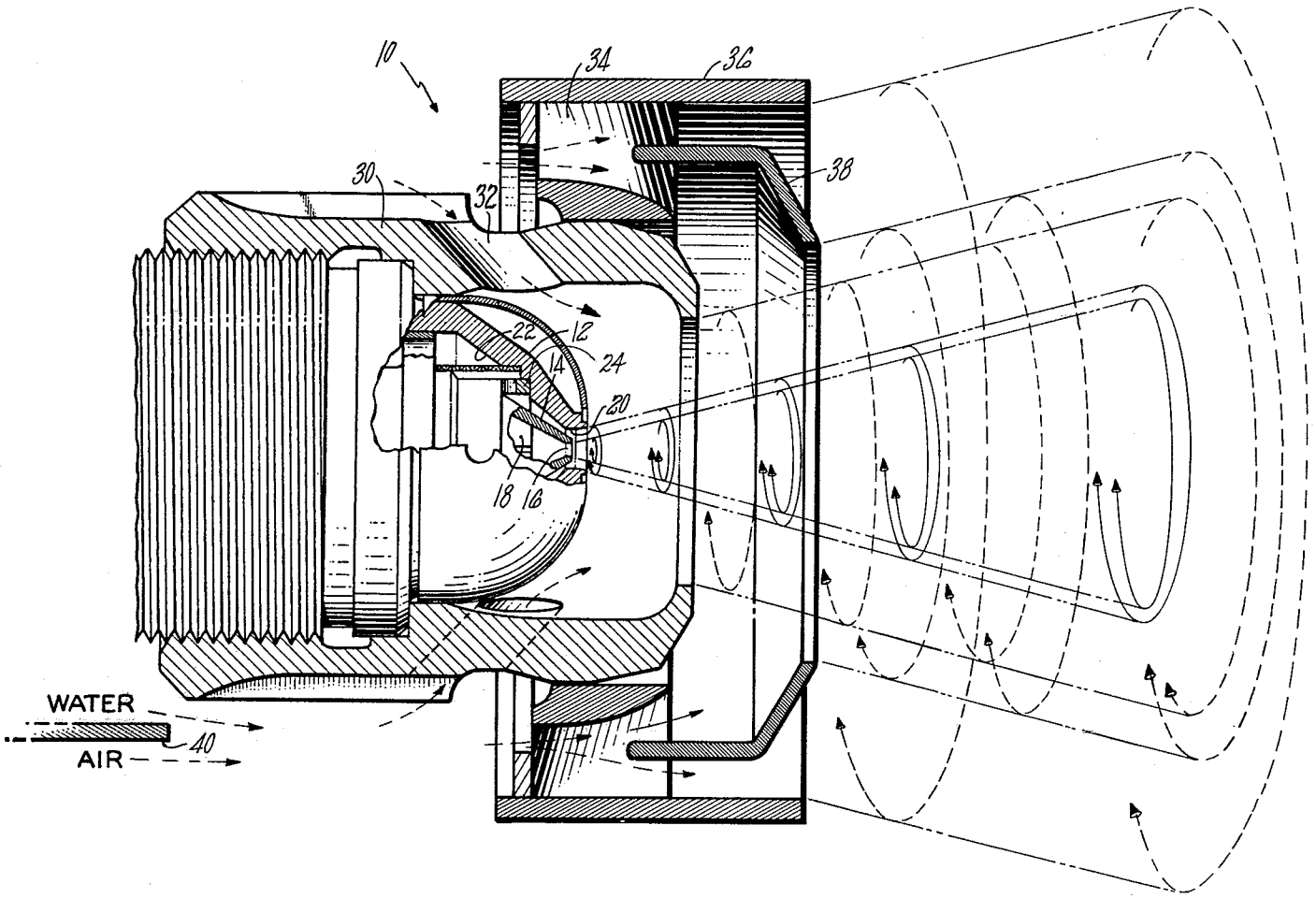
10
12
14
16
18
20
22
24
30
32
34
36
38
40
WATER
AIR

FUEL NOZZLES WITH WATER INJECTION FOR GAS TURBINE ENGINES

DESCRIPTION

TECHNICAL FIELD

This invention relates to fuel nozzles for gas turbine engines and particularly to fuel nozzles having a combined primary and secondary fuel injection system and adapted for water injection.

BACKGROUND ART

There has been a constant endeavor to increase the time between overhaul of jet engines that power aircraft and to reduce smoke and pollutants emitted into the atmosphere. This invention addresses itself to both of these problems.

As is well known, thrust of the engine can be increased by adding water to the burner section. In fuel nozzles for certain engines both the primary and secondary fuels are injected into the burner in conically radiating spray patterns that are in coaxial relationship. Such nozzles are, for example, utilized on the JT-9D engine manufactured by Pratt & Whitney Aircraft Group of United Technologies Corporation, the assignee of this patent application and the details of which are incorporated herein by reference. In this configuration, water is admitted upstream of the fuel spray and passes through the fuel support heat shields prior to being injected into the burner section via the burner swirlers. The problem with this configuration is that a significant deterioration in burner performance was evidenced. Also, this type of water injection system manifested a high smoke density, produced excessive hot spots at the turbine inlet as well as excessive distortions of the turbine inlet temperature radial profile.

It is also well known that fuel and air are injected into a burner with a tangential component so as to achieve a fast and complete mixing. Since water is admitted upstream of the juncture where it mixes with the fuel, it is carried in the airstream and assumes the same rotational direction. Hence, the fuel nozzle contains spin slots and vanes that are designed to impart a swirl to both the fuel and air. Further, the fuel nozzle is designed so that the fuel and air pattern in the burner combustion zone take the form of cones radiating from the apex as it leaves the fuel nozzle and flares into a cone as it propagates downstream in the burner.

In heretofore nozzle configurations it has been conventional to impart the swirl of the fuel in a direction that is counter to the direction of the swirl of the air.

We have found that we can obviate the problems noted above in the water injection mode by changing the relationship of the direction of the swirl so that the fuel and air/water mixture both swirl in the same direction. This inhibits the tendency of the outer cone (air/water mixture) to collapse the inner cone (fuel spray) as is the case in the counter rotation swirl patterns and improves the circumferential uniformity of burning and thus prevents localized hot spots that manifest into the turbine. The water in the airstream does not collapse the fuel pattern and does not tend to conglomerate in individualize streams. Actual tests have shown a remarkable reduction in smoke emission during wet performance as compared with wet performance of heretofore known water injection systems.

DISCLOSURE OF INVENTION

An object of this invention is to provide for a gas turbine engine an improved water injection fuel nozzle.

A feature of this invention is to provide means in the fuel nozzle that produce swirling of the fuel, air, and air/water mixture so that the tangential component is in the same direction for each stream being injected into the burner.

Other features and advantages will be apparent from the specification and claims and from the accompanying drawing which illustrates an embodiment of the invention.

BRIEF DESCRIPTION OF THE DRAWING

The sole FIGURE is a partial view partly in elevation and partly in section illustrating the invention.

BEST MODE FOR CARRYING OUT THE INVENTION

In its preferred embodiment this invention has particular utility for pressure atomized fuel nozzles that include both the primary and secondary fuel systems. For details of this type of nozzles reference should be made to the fuel nozzles utilized in the JT-8D and JT-9D engines manufactured by Pratt & Whitney Aircraft Group of United Technologies Corporation, the assignee of this patent application. Inasmuch as this invention only relates to the fuel nozzle the details of the engine and its combustor, fed by these nozzles, are eliminated herefrom for the sake of convenience and simplicity. Suffice it to say that the engines noted above utilize dual orifice fuel nozzles having pressure atomizing primary and pressure atomizing or air atomizing secondary nozzles where the primary nozzle is utilized for both low and high thrust engine operation and the secondary nozzle is operative only at the higher thrust regimes.

As can be seen in the sole FIGURE, the nozzle generally illustrated by reference numeral 10 comprises a generally dome shaped body 12 including the cone body 14 defining the primary nozzle. Fuel issues from orifice 16 in a swirling pattern imparted thereto by the swirl plug 18. As can be seen the swirling fuel flares into a conical pattern as it progresses into the combustion zone (not shown).

Secondary fuel is introduced into the combustion zone through the annular orifice 20 which is fed thereto through this annular passageway 22 formed between the primary nozzle 14 and the nozzle structure 12. The swirl ring 24 serves to inpart a vortex swirl pattern similar to the primary fuel pattern generated by swirl plug 18. This fuel likewise flares into a conical pattern as it progresses into the fuel zone. As is well known, the angle of the slots in the swirl ring 24 and swirl plug 18 serve to provide the direction of the swirl. The tangential velocity and the strength of the swirl will depend on the particular environment to which this nozzle is utilized.

Air, likewise, is injected into the combustion zone in a swirling fashion. A portion of the air from the compressor (not shown) is admitted internally of nozzle nut 30, via swirl slots 32 and assumes the conical flow pattern as it progresses into the combustion zone. The remaining air is directed to the swirl vanes 34 in the swirl cup 36 where a portion thereof is split by splitter 38 and assumes the flow patterns as shown. As is well known, for water injection, water is admitted into the airstream at a given location upstream of the swirling means shown as inlet 40 and is carried in the airstream and swirled therewith through nozzle nut 30 and cup 36.

As can be seen by the sole FIGURE the direction of swirl for both the fuel and air/water mixture streams are in the same direction. This co-rotational aspect serves to prevent the water droplets from coalescing into a localized stream that would otherwise distort the temperature profile emanating from the combustor. From actual tests, it has been found that the co-rotational aspect has improved burner performance and reduced smoke emissions from the engine's exhaust during water injection modes.

It should be understood that the invention is not limited to the particular embodiments shown and described herein, but that various changes and modifications may be made without departing from the spirit and scope of this novel concept as defined by the following claims.

We claim:

1. A fuel nozzle for a combustor for a gas turbine engine having a primary and secondary fuel system, a first generally conically shaped outer casing and a second generally conically shaped inner casing disposed in coaxial relationship and defining a first passageway communicating with a first orifice formed in the inner casing in a transverse plane for issuing fuel from said primary fuel system and defining a second passageway communicating with a second orifice formed in the outer casing disposed in said transverse plane for issuing fuel from said secondary fuel system, swirl means in said first passageway for imparting a swirl motion to the fuel issuing from said first orifice and swirl means in said second passageway for imparting a swirl motion to the fuel issuing from said second orifice, air swirl means disposed coaxially relative to said first orifice and said second orifice for imparting a swirl motion to the air issuing from said fuel nozzle and means for injecting water into said air just prior to said air swirl means, said swirl means in said first passageway and in said second passageway, said air swirl means imparting swirl to the fuel and water ladened air in the same direction and a nozzle nut disposed coaxially relative to the axes of said first passageway and said second passageway, swirl slots in said nozzle nut for receiving and imparting a swirl motion to the air ladened water in the same direction as the swirl of the fuel issuing from said first orifice and said second orifice.

2. A fuel nozzle as in claim 1 including an air swirl cup surrounding said nozzle nut having air swirl vanes disposed coaxially relative to said nozzle nut for receiving and imparting a swirl motion to the air ladened water in the same direction as the swirl of the fuel issuing from said first orifice and said second orifice.

3. A fuel nozzle for a combustor for a gas turbine engine having a fuel system, a first generally conically shaped outer casing and a second generally conically shaped casing defining a passageway communicating with an orifice formed in said casing for issuing fuel from said fuel system, swirl means in said passageway for imparting a swirl motion to the fuel issuing from said orifice, air swirl means disposed coaxially relative to said first orifice for imparting a swirl motion to the air issuing from said fuel nozzle and means for injecting water into said air just prior to said air swirl means, said swirl means in said passageway imparting swirl to the fuel and water ladened air in the same direction, a nozzle nut disposed coaxially relative to the axes of said passageway, swirl slots in said nozzle nut for receiving and imparting a swirl motion to the air ladened water in the same direction as the swirl of the fuel issuing from said orifice.

4. A fuel nozzle as in claim 3 including an air swirl cup surrounding said nozzle nut having air swirl vanes disposed coaxially relative to said nozzle nut for receiving and imparting a swirl motion to the air ladened water in the same direction as the swirl of the fuel issuing from said orifice.

* * * * *